United States Patent [19]

Hayashi et al.

[11] Patent Number: 4,701,582

[45] Date of Patent: Oct. 20, 1987

[54] PLUNGER SENSING SWITCH

[75] Inventors: Mitsuji Hayashi, Nagaokakyo; Takashi Niwa; Akihiko Hayakawa, both of Kyoto; Hideyuki Bingo, Uji; Shoji Kazusaka; Keisuke Konishi, both of Takatsuki, all of Japan

[73] Assignee: Omron Tateisi Electronics Co., Kyoto, Japan

[21] Appl. No.: 831,424

[22] Filed: Feb. 20, 1986

[30] Foreign Application Priority Data

Feb. 22, 1985 [JP] Japan ..... 60-34953
Feb. 28, 1985 [JP] Japan ..... 60-29447[U]
Mar. 4, 1985 [JP] Japan ..... 60-31410[U]

[51] Int. Cl.[4] ..... H01H 3/16

[52] U.S. Cl. ..... 200/61.42; 200/61.76; 200/61.78

[58] Field of Search ..... 200/16 B, 61.41, 61.42, 200/61.44, 61.69, 61.76–61.81, 159 R, 276, 302.2, 302.3, 330, 339, 302.1

[56] References Cited

U.S. PATENT DOCUMENTS

| | | | |
|---|---|---|---|
| 2,090,178 | 8/1937 | Brickner | 200/61.42 |
| 2,573,139 | 10/1951 | Hoffman | 200/61.41 |
| 3,171,012 | 2/1965 | Morehead | 200/61.41 X |
| 3,746,810 | 7/1973 | Parsons et al. | 200/276 X |
| 3,881,077 | 4/1975 | Piber | 200/61.69 |
| 4,564,730 | 1/1986 | Tomizu et al. | 200/61.76 X |

*Primary Examiner*—J. R. Scott
*Attorney, Agent, or Firm*—Stevens, Davis, Miller & Mosher

[57] ABSTRACT

A switch comprising a cylindrical housing, an actuator mechanism disposed at one end of the housing for contacting an object to be sensed by the switch, a plunger slidably housed within the housing for receiving a displacement by the actuator mechanism, and a switching mechanism associated with the plunger for switching a circuit in accordance with the actuation by the plunger. The actuator mechanism includes a conical supporting member tiltably engaged with a flange member formed in the aforesaid one end of the housing.

12 Claims, 10 Drawing Figures

P
55
51
53
52
54
5
6
1
4
2
23
24
25
21
226
22b
22a
14
35
31
32
33
3

PLUNGER SENSING SWITCH

FIELD OF THE INVENTION

This invention relates to sense switches which may be employed in various machines, such as industrial robots, machine tools, automatic vendors or the like.

BACKGROUND OF THE INVENTION

It is desirable in some sense switch applications that the switches be small in size and able to provide precise switching operations with respect to an external weak operation force applied to their actuators in any directions. Further, it is often desirable that the switches be easy to assemble and ensure long mechanical life. A type of sense or limit switch is well known in which an actuator is moved by an external force in one direction to apply external forces to a contact switching mechanism communicated therewith. The foregoing features are, however, not satisfied by such a well known switch. One type of conventional switch is small in size, but its actuator is designed to move only one direction or difficult to assemble. Another type of conventional switch is actuatable with respect to external forces in three dimensional directions, but is large in size or operation forces.

SUMMARY OF THE INVENTION

It is therefore a primary object of this invention to provide a sense switch which is small in size and provides precise-stable switching operations.

It is a further object of this invention to provide a cylindrical-type sense switch which is sensitive to light external forces in all directions and ensures a long mechanical life.

It is a still further object of this invention to provide a switch which is easy to assemble and mount, and suitable for sensors of industrial robots.

In one embodiment of this invention there is provided a sense switch comprising a cylindrical housing, an actuator member disposed at one end of the housing for contacting an object to be sensed by the switch, a plunger member slidably housed within the housing for receiving a displacement by the actuator member, and a switching member associated with the plunger member for switching a circuit in accordance with the actuation by the plunger member, with the actuator member including a conical supporting member tiltably engaged with a flange member formed in one end of the housing.

BRIEF DESCRIPTION OF THE DRAWINGS

For a more complete understanding of this invention reference should be made to the drawings, in which.

DETAILED DESCRIPTION OF THE PREFERRED EMBODIMENTS

Figure 1:
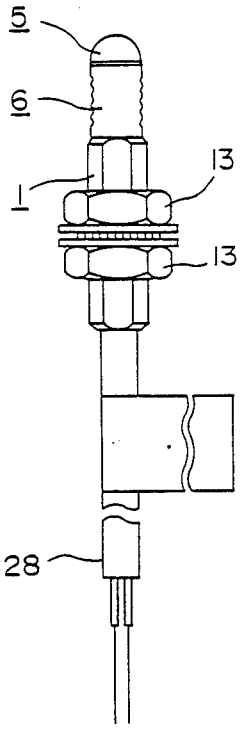
FIG. 1 shows a side view of a sense switch as a preferred embodiment of this invention.

Returning to FIGS. 1 through 3 there is shown a sensor switch as a preferred embodiment of this invention. The switch includes a cylindrical housing 1 adapted to be fixed to an external machine device for mounting the switch thereon, a switching base 2 housing a switching mechanism 21 therewithin to be inserted within the housing 1 so that it is held in a fixed position therewithin, a plunger member 3 slidably held within the housing 1 for actuating the switching mechanism 21, a reset spring 4 interposed between the plunger member 3 and the switching base 2 for upwardly biassing the plunger member 3, and an actuator member 5 for actuating the plunger member 3 when it leans or moves along an axial direction.

Figure 2:
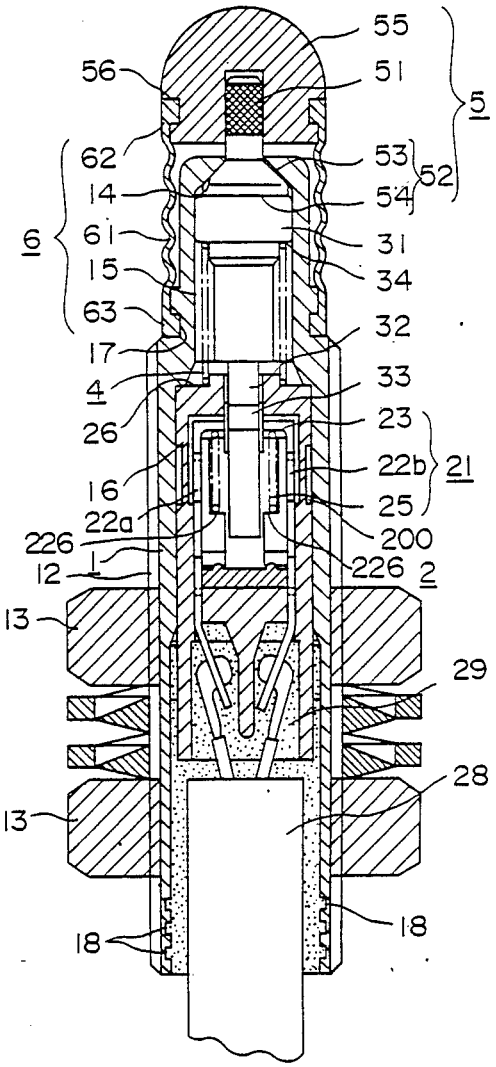
FIG. 2 shows a front and sectional view of the switch.
Figure 3:
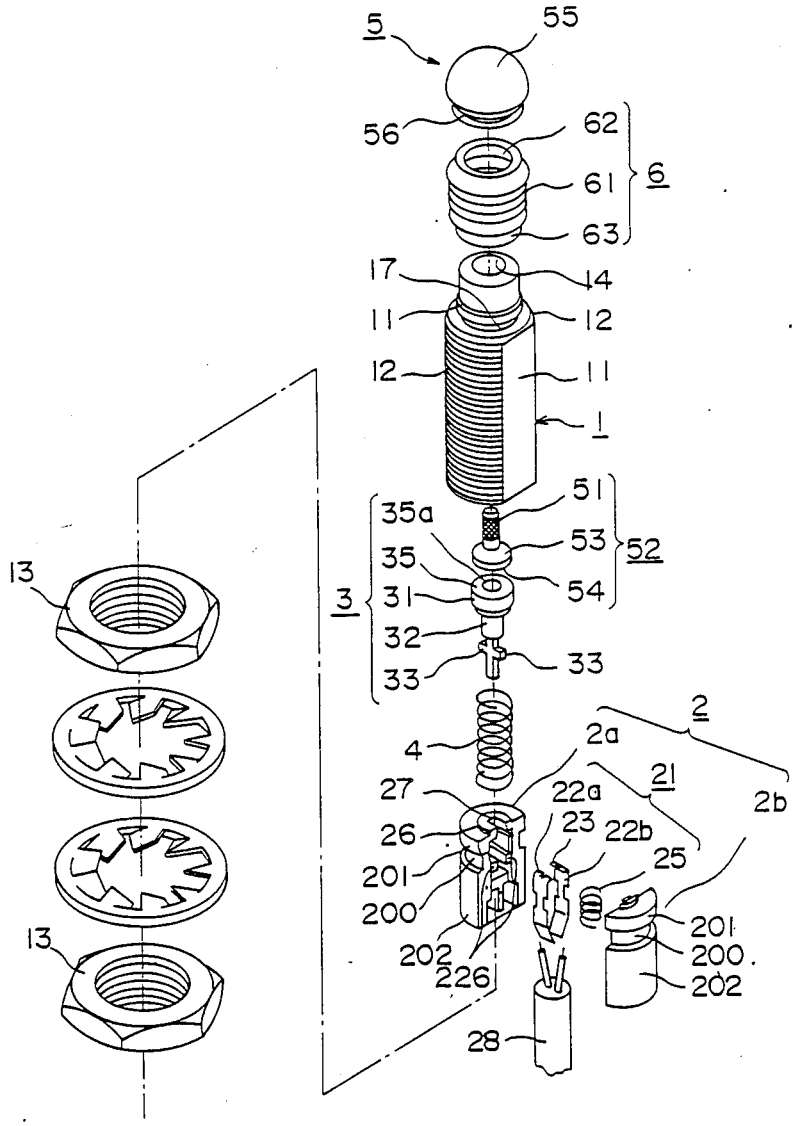
FIG. 3 shows a perspective, disassembled view of the switch.

The cylindrical housing 1 on an external side surface is provided with a pair of opposite flat portions 11 and screw portions 12 extending between the portions 11 to be engaged with a pair of mounting nuts 13. The flat portions 11 ensure smooth engagement with the nuts since any scrap or difference in screw is prevented from being produced on the screw portions 12 by bringing a gate mouth or in-gate and a parting line to the flat portions on molding the housing 1. Moreover, the flat portions 11 prevent unnecessary roll of the housing 1 when switch parts are installed within the base, and serve as a chuck member for tools. The nuts 13 are serviceable from the top or the bottom of the housing 1 whereby the mounting work for the switch on the external machine device is improved. The housing 1 is further provided with a conical flange 14 forming an upper opening through which the actuator member 5 extends upwardly, and therewithin forms a plunger room 15 for the plunger member 3 and a switch room 16 inserted by the switching base 2 as illustrated in FIG. 2.

Figure 4:
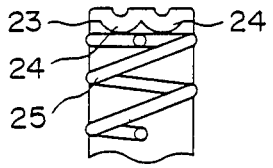
FIG. 4 shows a partial front view of a stationary terminal and a coil spring employed in the switch.

The switching base 2 has such a cylindrical shape to fit with the switch room of the housing 1, and is divided into a base portion 2*a* and a cover portion 2*b* (FIG. 3) along an axial direction of the base 2 shifting from the central axis thereof. The base portion 2*a* within a recess thereof receives a pair of opposite terminals 22*a* and 22*b* at lower ends thereof connected with wires of a cable 28, and a coil spring 25 supported at its base on housing support 226 and adapted to come into contact with a pair of stationary contacts 23 represented by top ends of the terminals 22*a* and 22*b* extending inwardly, whereby normally-closed switching mechanism 21 is constituted and housed within the base portion 2*a* which is coupled with the cover portion 2*b* by engagement between the recess within the portion 2*a* and a projection (hidden in FIG. 3) formed in the portion 2*b*. It is advantageous on assembling work that such miniature parts as the terminals and the coil spring can be installed into the base portion 2*a* before covered with the portion 2*b*. As illustrated in FIG. 4, the stationary contact 23 includes a plurality of ribs 24 to concentrate a contact pressure by the spring 25 on the ribs, thus ensuring the contact between the contact 23 andd the spring 25. On upper end of the switching base 2 there are provided a receiving portion 26 for receiving the spring 4 and a plunger guide hole 27 for slidably supporting the plunger member 3.

The plunger member 3 which is a mold made of synthetic resin includes a guide shaft 31 adapted to fit with the plunger room 15 of the housing 1, a hemispherical hollow 35*a* formed on a top wall 35 for contacting the actuator member 5, and an actuator shaft 32 extending within the coil spring 25 and carrying a pair of opposite projections 33 for actuating an upper end of the spring 25. The reset spring 4 is supported by a receiving portion 34 formed at a lower end of the guide shaft 31 and the receiving portion 26 of the switching base 2, whereby the projections 33 are reset to their original positions, thus normally releasing the spring 25 from actuation by the projections. The plunger guide hole 27 is a rectangular groove extending through the base portion 2*a* so that the projections 33 can be downwardly guided by the groove without changing their directions, whereby switching operations are ensured. The hemispherical hollow portion 35*a* is disposed for collecting foreign matter produced from the rubbing of the wall 35 of the guide shaft 31 by a bottom wall 54 of the actuator member 5 or lubricating oil excessively applied to the wall 54, so that the stroke by the plunger member 3 is ensured without affection by such foreign matter and the switching mechanism 21 is prevented from intrusion by the oil.

Figure 5:
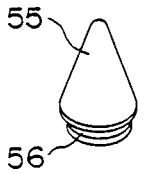
FIGS. 5 and 6 shows other detection heads replaceable in the switch.
Figure 6:
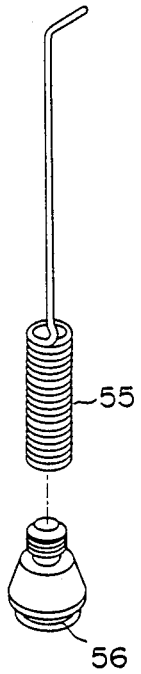

The actuator member 5 consists of a detection head 55 and a conical supporting member 52 including a mounting shaft 51 engaged with the head 55 and a tapered wall 53 fitting with the conical flange 14. The conical supporting member 52 is so interposed between the flange 14 of the housing 1 and the top wall 35 of the plunger member 3 that it is biased to the flange 14 by the reset spring 4 through the plunger member 3. The mounting shaft 51 is provided with a knurled surface which is forcibly inserted into the head 55 for engagement therewith, thus the head 55 is replaceable with other heads shown in FIG. 5 or 6. The surface of the shaft 51 may be modified to form a screw shape so that the head 55 can be mounted on the shaft 51 in a screw-and-nut relationship. Between the head 55 and the housing 1 there is interposed a flexible seal member 6 including a cylindrical rubber member 61 having opposite inwardly projecting circular ends 62 and 63 which are respectively engaged with a groove 56 on the head 55 and a groove 17 on upper portion of the housing 1 whereby the head 55 is hermetically connected with the housing 1 for a free direction movement.

As illustrated in FIG. 2, the lower opening of the housing 1 accepting the switching base 2 and the cable 28 is filled with sealing agent 29 so that electrical insuration and watertight sealing can be ensured. Moreover, a plurality of circular grooves 18 are formed on an inner wall of the housing at the lower end thereof, whereby the mechanical strength against pulling force by the cable 28 is reinforced.

The switching base 2 on its side wall is provided with a circular groove 200 so as to have supporting surfaces 201 and 202 come into contact with an inner wall of the housing 1, whereby the friction force for inserting the body 2 within the housing 1 is decreased thus improving assembling work, and any scraps produced by the insertion of the body enter into the groove 200. As a result, the centering of the switching body 2 in the housing is ensured, and any erroneous switching operation by center-line shaft is avoided. Moreover, the groove 200 improves the tolerance of molding the base 2.

Figures 7A, 7B, 7C:
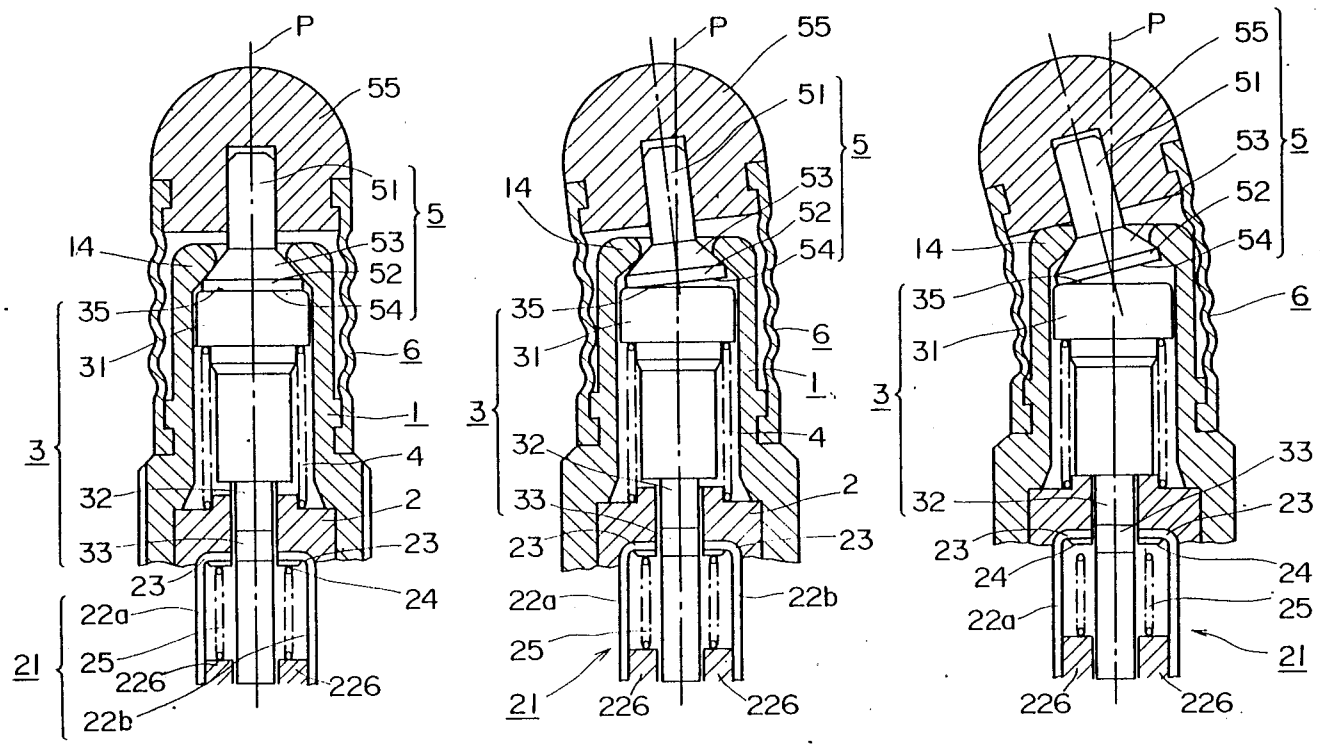
FIGS. 7(A), 7(B) and 7(C) show sectional views illustrating the operations of the switch.

Returning to FIGS. 7(A), 7(B) and 7(C) the operations of the sense switch are described hereinafter. In FIG. 7(A) which shows a normal position of the switch, the actuator member 5 is biased by the reset spring 4 and the flexible seal member 6 so that the projections 33 of the plunger member 3 is out of engagement with the coil spring 25 making a normally closed circuit with the stationary contacts 23.

In FIG. 7(B), as the detection head 55 comes into contact with a work to lean the actuator member 5 with respect to the central axial line P, the conical supporting member 52 at its leaning side is displaced to its smaller diameter portion and at its opposite side to its larger diameter portion with respect to the conical flange 14 whereby the bottom wall 54 at the leaning side is depressed according to the displacement of the supporting member 52 to depress the plunger member 3 on its top wall 35 to some extent.

In FIG. 7(C), as the actuator member 5 leans to a predetermined position, the projections 33 of the plunger member 3 depress the coil spring 25 to break the circuit between the stationary terminals 22*a* and 22*b* through the coil spring so that an electrical signal representing the work detection by the switch is produced from the terminals.

Figure 8:
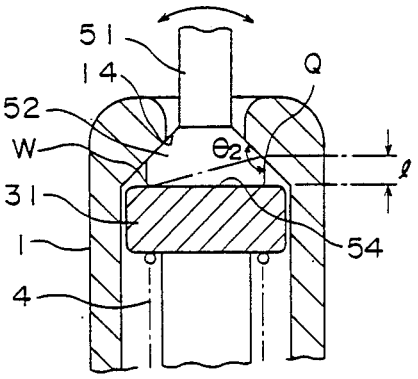
FIG. 8 shows a partial and sectional view of the switch.

Thus, as illustrated in FIG. 8, when the mounting shaft 51 leans to its left-hand side, the conical supporting member 52 swings downwardly with respect to its supporting point Q and the actuating point W of the member 52 slides on the wall 35 of the plunger member 3 to depress the same. The distance (l) between the points Q and W in a longitudinal axial direction of the actuator member 5 is so short that the movement of the point W is decreased minimizing its friction force applied against the wall 35. The wide angle $\theta$ in the supporting member 52 decreases its force applied friction against the flange 14 so that its mechanical life is improved.

When the actuator member 5 is actuated by an external force in its axial direction, the supporting member 52 directly depresses the top wall 35 without leaning so as to leave the coil spring from the contacts 23 for producing the above-mentioned electric signal. Thus, the actuator member 5 is movable in any directions.

As the detection head 55 leaves the work to be sensed by the switch, the plunger member 3 and the actuator member 5 are driven to their original positions by coil spring 25, reset spring 4 and flexible seal member 6.

According to this embodiment, the reset spring 4 and the coil spring 5 are aligned in the same direction, so that the operation stroke can be designed to be large with mechanical long life. Moreover, the coil spring 25 may be a tiny spring whereby the sense switch is miniaturized, particularly in its diameter.

Many modifications of the foregoing embodiment are possible and therefore the scope of this invention should be determined from following claims.

What is claimed is:

1. A switch, comprising:

a cylindrical housing having a fixed flange member formed at one end, said flange member having a conical surface, actuator means disposed at said one end of the housing for contacting an object to be sensed by the switch, plunger means slidably housed within the housing and slidable within said housing responsive to a displacement of the actuator means, and switching means in contact with the plunger means, said switching means being actuatable to switch a circuit contact means responsive to displacement of the plunger means, said actuator means including a conical supporting member having one surface in contact with said plunger means and an opposite conical surface tiltably engageable with said conical surface of said flange member.

2. A switch according to claim 1 in which said actuator means further includes a detection head engaged with a mounting shaft extending from said conical supporting member, said detection head for contacting said object to be sensed.

3. A switch according to claim 1 in which said plunger means includes a guide shaft on its top wall having a hemispherical hollow portion for contacting said actuator means.

4. A switch according to claim 1 further comprising a coil spring disposed in said housing and wherein said switching means includes a pair of stationary contacts to be selectively connected with each other through said coil spring actuatable by said plunger means.

5. A switch according to claim 4 in which said stationary contacts respectively include a plurality of ribs for making contact with the coil spring.

6. A switch according to claim 4, wherein said plunger means includes an actuating shaft which projects within said coil spring and has a pair of opposed projections for operatively engaging an upper end of said coil spring, whereby when said plunger means is displaced within said housing said opposed projections move said coil spring to selectively connect and disconnect said stationary contacts through said coil spring.

7. A switch according to claim 6, further comprising a switching base disposed within the housing and in which the switching means is housed, the switching base including guide groove means for guiding the opposed projections toward and away from the coil spring.

8. A switch according to claim 1 further comprising a switching base disposed within said housing and in which said switching means is housed, said switching base having a cylindrical shape divided into a base portion and a cover portion.

9. A switch according to claim 8 in which said plunger means includes a projection guided by said switching base for actuating said switching means.

10. A switch according to claim 5 in which said base portion and said cover portion form a continuous circular groove on said side walls thereof.

11. A switch according to claim 8, wherein said cover portion is offset relative to a central axis of said cylindrical switching base.

12. A switch according to claim 1 in which said housing has an external surface which includes a pair of opposite flat portions.

* * * * *